US006530383B1

(12) United States Patent
Rogmann et al.

(10) Patent No.: US 6,530,383 B1
(45) Date of Patent: Mar. 11, 2003

(54) AGENT FOR CLEANING HARD SURFACES

(75) Inventors: Karl-Heinz Rogmann, Ratingen (DE); Birgit Skodell, Dusseldorf (DE); Heiko Faubel, Wermelskirchen (DE)

(73) Assignee: Ecolab GmbH & Co. OHG, Dusselfdorf (DE)

( * ) Notice: Subject to any disclaimer, the term of this patent is extended or adjusted under 35 U.S.C. 154(b) by 0 days.

(21) Appl. No.: 09/890,660

(22) PCT Filed: Feb. 2, 1999

(86) PCT No.: PCT/EP99/00643

§ 371 (c)(1),
(2), (4) Date: Oct. 2, 2001

(87) PCT Pub. No.: WO00/46327

PCT Pub. Date: Aug. 10, 2000

(30) Foreign Application Priority Data

Nov. 22, 1997 (DE) ..... 197 51 859

(51) Int. Cl.[7] ..... B08B 1/00; B08B 3/04; C11D 1/825; C11D 3/02; C11D 3/37

(52) U.S. Cl. ..... 134/25.2; 134/39; 134/40; 134/42; 510/214; 510/421; 510/434; 510/476; 510/477

(58) Field of Search ..... 510/214, 421, 510/434, 476, 477; 134/25.2, 39, 40, 42

(56) References Cited

U.S. PATENT DOCUMENTS

| | | | | |
|---|---|---|---|---|
| 4,725,319 A | * | 2/1988 | Osberghaus | 134/4 |
| 5,126,068 A | * | 6/1992 | Burke et al. | 252/174.21 |
| 5,683,975 A | * | 11/1997 | Skodell et al. | 510/214 |

FOREIGN PATENT DOCUMENTS

| | | |
|---|---|---|
| DE | 40 39 348 A1 | 6/1992 |
| DE | 43 42 215 A1 | 6/1995 |
| DE | 44 15 804 A1 | 11/1995 |
| EP | 0 254 208 | 1/1988 |
| FR | 2 294 231 | 7/1976 |
| JP | 04-359096 | 12/1992 |
| JP | 07-118689 | 5/1995 |
| WO | WO 95/10589 | 4/1995 |

OTHER PUBLICATIONS

"Qualitatsnormen fur Fussodenpflege und reinigungsmittel." *Seifen–Ole–Wachse*–108. Jg–Nr. 16/1982 and English translation Dec. 1982.

* cited by examiner

*Primary Examiner*—Mark Kopec
*Assistant Examiner*—Brian P. Mruk
(74) *Attorney, Agent, or Firm*—Merchant & Gould P.C.

(57) ABSTRACT

The invention relates to an aqueous agent which is provided for cleaning hard surfaces and which comprises a pH value of greater than 7. The inventive agent comprises: A) 5 to 45 wt. % of at least one polymer which is soluble in the alkaline medium, which is not cross-linked by metal ions, and which has a temperature of film formation ranging from 0 and 80° C.; and B) 2 to 90 wt. % of a surfactant combination comprised of an alkoxylated linear $C_8$–$C_{18}$ fatty alcohol with 1 to 10 ethylene oxide groups and 1 to 5 propylene oxide groups per molecule, whereby the free OH group can be closed by a $C_1$–$C_4$ alkyl group, and is comprised of at least one additional surfactant selected from the group comprised of alkoxylated branched-chain $C_8$–$C_{18}$ alcohols with 1 to 8 ethylene oxide units in the molecule, whereby the free OH groups can be closed by a $C_1$–$C_4$ alkyl group, $C_8$–$C_{18}$ fatty alcohol ethoxylates with 1 to 12 ethylene oxide units in the molecule and hydroxy mixed ether corresponding to the following formula (I): $R^1O[CH_2CH(CH_3)O]_x(CH_2CHR^2O)_y[CH_2CH(OH)]_zR^3$ wherein $R^1$ represents a linear, aliphatic hydrocarbon radical with an average of 4 to 18 hydrocarbon atoms in the molecule including the mixtures thereof, $R^2$ represents a hydrogen atom or an alkyl group with 1 to 6 hydrocarbon atoms, and $R^3$ represents a linear, aliphatic hydrocarbon radical with an average of 2–14 hydrocarbon atoms in the molecule including the mixtures thereof, x equals 0 or 1 to 5, y equals 1 to 30, and z equals 1 to 3.

13 Claims, No Drawings

AGENT FOR CLEANING HARD SURFACES

This invention relates to a water-based composition for cleaning hard surfaces containing a combination of polymer compounds soluble in the alkaline range and nonionic surfactants and to the use of this composition for the machine-cleaning of floors.

In the cleaning of hard surfaces, the constituent materials of the surfaces to be cleaned and the nature and intensity of the soil and also economic factors have to be taken into account besides hygienic and aesthetic aspects. The hard surfaces include, for example, coverings of natural stones, tiles, such as fine stoneware tiles, and also elastic coverings, such as linoleum and PVC. In the institutional cleaning of hard surfaces, another factor to be taken into consideration is that the surfaces have different textures and, at the same time, different types of soil have to be removed, optionally with simultaneous disinfection depending on the particular application. For these reasons, various compositions have also been developed for this sector.

In practice, the choice of composition is largely determined by whether the composition performs the cleaning function on the various materials in a short time without harming them, irrespective of the type of soil. For economic reasons, machines are used for this purpose in institutional cleaning. Vacuum scrubbing machines (automatic cleaners) and scrubbing machines (single-disk or contrarotating multiple-disk machines or brush cylinder machines) are generally used for cleaning floors. In the latter case, the cleaning composition is removed by suction in a second operation carried out with a so-called wet vacuum cleaner.

The cleaning of floors with rough surfaces, for example stoneware tiles and unpolished natural and artificial stones, is attended by the problem that dirt settles very quickly on such floors because of their large surface. If cleaning compositions only are used, the surfaces become heavily soiled after only a very short time. In order to delay the redeposition of soil, cleaning is generally carried out in two steps, namely the cleaning step as such and subsequent surface protection of the floor covering. Products which contain both cleaning and floor care ingredients do not show adequate cleaning performance so that there is a continuous buildup of dirt.

Although combination products with better cleaning performance are also commercially available, they foam so vigorously that they are unsuitable for application by machine. In addition, the floor wiping compositions frequently contain floor care components which form a thick floor care film so that, despite intensive "vacuuming" during machine cleaning, the nonslip behavior of fine stoneware tiles can be adversely affected. Other attempts to develop combination products with enhanced cleaning performance often lead to problems during machine application on account of the unfavorable foaming behavior of such products. In addition, a relatively high surfactant content leads to sticky residues on floors which in turn result in more intensive soiling of the floor.

On the other hand, the solubility of film-forming substances is only limited so that they do not dissolve completely and cannot be removed completely, if at all, when the floor is next cleaned so that a thick floor care film can be built up. This again adversely affects the nonslip behavior and appearance of the floor and makes special cleaning necessary at certain intervals.

Accordingly, the problem addressed by the present invention was to improve conventional cleaning compositions and, at the same time, to develop cleaning compositions for hard surfaces, particularly for the institutional sector, which would show good cleaning performance and, at the same time, would preserve the surface so that cleaning could be carried out in a single operation and preferably with automatic cleaning machines.

The present invention relates to a water-based composition with a pH above 7 for cleaning hard surfaces, characterized in that it contains A) 5 to 45% by weight of at least one polymer compound which is soluble in the alkaline range, is not crosslinked through metal ions and has a film-forming temperature of 0 to 80° C. and B) 2 to 90% by weight of a surfactant combination of alkoxylated linear $C_{8-18}$ fatty alcohol containing 1 to 10 ethylene oxide groups and 1 to 5 propylene oxide groups per molecule, the free OH group optionally being end-capped by a $C_{1-4}$ alkyl group, and at least one other surfactant from the group consisting of alkoxylated branched-chain $C_{8-18}$ alcohols containing 1 to 8 ethylene oxide units in the molecule, the free OH groups optionally being end-capped by a $C_{1-4}$ alkyl group, $C_{8-18}$ fatty alcohol ethoxylates containing 1 to 12 ethylene oxide units in the molecule and hydroxy mixed ethers corresponding to formula (I):

$$R^1O[CH_2CH(CH_3)O]_x(CH_2CHR^2O)_y[CH_2CH(OH)]_zR^3 \quad (I)$$

where $R^1$ is a linear aliphatic hydrocarbon radical containing on average 4 to 18 carbon atoms in the molecule, including mixtures thereof, $R^2$ is a hydrogen atom or an alkyl group containing 1 to 6 carbon atoms and $R^3$ is a linear aliphatic hydrocarbon radical containing on average 2 to 14 carbon atoms in the molecule, including mixtures thereof, x=0 or 1 to 5, y=1 to 30 and z=1 to 3.

In one particularly advantageous embodiment, components A and B are present in a ratio of 1:1 to 10:1 and preferably 5:1 to 1:1.

The compositions according to the invention are preferably diluted with water for use, the concentration in which they are applied generally being between 0.5 and 5% by weight and preferably between 2 and 5% by weight, based on the solution. They may be applied manually or by conventional automatic cleaners, for example by applying the cleaning solution and machine-scrubbing the floor with vacuum or other scrubbing machines. The partly dissolved soil is thoroughly dispersed in the cleaning solution so that it is not redeposited in the pores of the floor material before the solution is removed by suction. The floor is not rinsed after the scrubbing/vacuuming process and the residual moisture remaining dries. A paper-thin floor care film is formed on the surface, preventing or reducing the adhesion of soil. This floor care film is completely re-dissolved the next time the floor is cleaned and re-forms from the residual moisture remaining.

The cleaning composition according to the invention is distinguished in particular by the fact that the surfactant combination removes a broad spectrum of oily and pigment-containing soil types. The cleaning composition according to the invention matches the cleaning performance of the particularly detersive anionic cleaning compositions, but has the advantage that it does not form excessive volumes of foam in use which would impair the continuous operation of automatic cleaning machines.

Where the cleaning composition according to the invention is used in the cleaning of surfaces, there is no buildup of the floor care film because it is completely dissolved again when the floor is next cleaned. The thinness of the film and its properties also ensure that the tiles are safe to walk on.

Polymers suitable for use in accordance with the invention are, generally, any polymer compounds soluble in water in the alkaline range providing they are not metal-crosslinked. The film-forming temperature is preferably in the range from 0 to 80° C. (Meth)acrylic acid (ester) copolymers are preferred. Solubility is generally achieved through carboxylic acid groups. Preferred polymers contain a (meth)acrylate copolymer of 1 to 30 parts by weight, based on the copolymer, of carboxylic-acid-containing monomers, 30 to 70 parts by weight, based on the copolymer, of monomers which form homopolymers with glass transition temperatures below 20° C., preferably $C_{1-6}$ alkyl esters of acrylic acid and/or $C_{4-8}$ alkyl esters of methacrylic acid, and 30 to 70 parts by weight, based on the copolymer, of comonomers which form homopolymers with glass temperatures above room temperature, preferably $C_{1-3}$ alkyl esters of (meth)acrylic acid or styrene.

Suitable comonomers containing carboxylic acid groups are, in particular, ethylenically unsaturated carboxylic acids, acrylic acid and methacrylic acid being preferred.

Suitable comonomers with glass transition temperatures below 20° C., i.e. glass temperatures below room temperature (based on the homopolymers of the monomers) are $C_{1-3}$ alkyl esters of (meth)acrylic acid such as, for example, methyl methacrylate or ethyl methacrylate. A particularly preferred comonomer of which the homopolymer has a glass temperature above room temperature is styrene.

Preferred copolymers are those of acrylic acid and/or methacrylic acid with styrene, acrylates and/or methacrylates. The copolymers of (meth)acrylic acid with (meth) acrylates and/or styrene, for example copolymers of methyl acrylate, ethyl acrylate, methacrylic acid and styrene, are particularly preferred.

The monomers are present in the copolymers in such quantity ratios that the film-forming temperature of the final copolymer dispersion is between 0 and 80° C. Adjusting the quantity ratios of comonomers to obtain this film-forming temperature is familiar ground to the expert. The film-forming temperatures mentioned relate to plasticizer-free systems, i.e. to copolymers with no other additives.

Polymers which are only soluble in water in the alkaline range, but insoluble in the acidic range, are preferably used. Such products are commercially available in emulsified form.

The composition according to the invention contains the polymers of component A in a quantity of 5 to 45% by weight, preferably 5 to 30% by weight and more preferably 8 to 20% by weight, based on the final composition and expressed as pure polymer.

The surfactants present as component B are commercially available products which are present in a quantity of 2 to 90% by weight, preferably 5 to 65% by weight and more preferably 5 to 35% by weight, based on the final composition.

The pH value of the compositions according to the invention is preferably between 8 and 10 to guarantee the solubility of the polymer compounds of component A. Suitable alkalizing agents are both volatile and solid alkalis, such as NaOH and KOH, alkali metal carbonates, ammonia, waterglass and/or amines, such as alkylamines and alkanolamines, ammonia or alkanolamines preferably being used. A factor to be taken into account with regard to the quantity of alkalizing agent used is that, where commercially available polymer emulsions are used as component A, they may already contain small quantities of alkalizing agents.

The compositions according to the invention may contain as further ingredients anionic surfactants and other nonionic surfactants different from component B as co-surfactants, alkalizing agents, alkaline complexing agents, water-miscible organic solvents, detersive salts, solubilizing agents and other typical additives.

Suitable anionic co-surfactants are, in particular, $C_{8-22}$ alkane sulfonates, $C_{8-22}$ alkyl benzenesulfonates, $C_{8-22}$ alkyl sulfates, $C_{8-22}$ fatty acid ester sulfonates, $C_{8-22}$ fatty alcohol ether sulfates, fatty acid soaps or mixtures thereof. Anionic co-surfactants may be used in a quantity of up to 3% by weight and preferably in a quantity of 0.5 to 1% by weight, based on the final composition.

Suitable nonionic co-surfactants are, for example, the adducts of 13 to 40 moles of ethylene oxide with $C_{8-22}$ alcohols or the adducts of 1 to 40 moles of ethylene oxide with $C_{8-22}$ alkyl phenols and the alkyl polyglycosides. The nonionic co-surfactants may be used in a quantity of up to 8% by weight, preferably up to 6% by weight and more preferably up to 2% by weight, based on the final composition.

The cleaning compositions according to the invention may be formulated as so-called normal products, as concentrates and as pastes, the transitions between these products being fluid as well-known to the expert. Normal products are generally liquid and represent solutions of their ingredients. The so-called concentrates are solutions or emulsions of the ingredients and have a liquid to thickly liquid consistency. Typically, surfactants may be present in normal products in a quantity of up to 35% by weight, in concentrates in a quantity of up to 65% by weight and in pastes in a quantity of up to 90% by weight. The third possible embodiment are pastes which may be dispensed through suitable dispensers. The pastes contain the active ingredients in a quantity of up to 95% by weight. Pastes are preferably free from additives and solvents.

The compositions according to the invention may contain as further optional constituents complexing agents which are capable of neutralizing the adverse effects of extremely hard water in the practical application of the compositions. Particularly suitable complexing agents are pentasodium triphosphate, trisodium citrate, sodium gluconate, tetrasodium methylene diamine tetraacetate (EDTA-Na), products based on polyaspartic acid and trisodium nitrilotriacetate (NTA-Na). NTA-Na and/or sodium gluconate are preferably used. The complexing agents may be used in a quantity of up to 8% by weight and are preferably used in a quantity of 0.5 to 5% by weight, based on the final composition. If the composition contains phosphates, its content of complexing agents may be smaller.

To boost its cleaning performance, the composition may contain water-miscible organic solvents, solvents with a good fat-dissolving effect being preferred. Examples of suitable solvents are mono- and dialcohols, ether alcohols and polyethers.

Typical representatives are isopropanol, butyl glycol, ethylene glycol monophenyl ether, dimethyl diglycol and methyl pyrrolidone. Lower ether alcohols, for example mono- or diethylene monoalkyl ethers containing 1 to 4 carbon atoms in the alkyl group, are preferably used. The solvent content of the composition does not exceed 30% by weight and is preferably no more than 20% by weight and, more particularly, between 0.5 and 10% by weight, based on the final composition.

Besides the compounds mentioned as alkalizing agents, the performance of the compositions according to the invention can be enhanced by addition of other salts showing an alkaline reaction such as, for example, polyphosphates or pyrophosphates, more particularly sodium tripolyphosphate or tetrapotassium pyrophosphate. These salts are preferably used in a quantity of 2 to 8% by weight, but at most 15% by weight, based on the final composition.

To stabilize the individual components in the cleaning compositions according to the invention, the compositions may contain solubilizers such as, for example, cumene sulfonate, octyl sulfate, toluene sulfonate, xylene sulfonate or urea. The solubilizers may be present in the composition according to the invention in quantities of up to 10% by weight and more particularly 1 to 6% by weight, based on the final composition. Fatty acid soaps also have solubilizing properties. Accordingly, if the cleaning composition contains soap, its solubilizer content may generally be very small.

The compositions according to the invention may also contain inorganic neutral salts, dyes and perfumes, thickeners and corrosion inhibitors and optionally disinfectants as further optional constituents. The content of these additives in the composition is preferably no more than 5% by weight, more preferably no more than 2% by weight and, in one particularly preferred embodiment, is between 0.05 and 1% by weight, based on the composition as a whole. Other additives typically encountered in cleaning compositions for institutional purposes may also be present providing they do not impair the effect according to the invention.

In one possible embodiment of the present invention, the compositions contains 5 to 30% by weight of a polymer of component A, 2 to 45% by weight of surfactants of component B, up to 6% by weight of other nonionic surfactants, up to 2% by weight of anionic surfactants, up to 30% by weight of alkalizing agents, up to 5% by weight of alkaline complexing agents, up to 30% by weight of water-miscible organic solvents and up to 8% by weight of other additives, such as solubilizers, thickeners, dyes and perfumes.

The present invention also relates to the use of the compositions described above for cleaning hard surfaces, more particularly floors with a rough surface, preferably for the machine cleaning of floors.

The present invention also relates to a process for the machine cleaning of hard surfaces in which the surfaces are treated in known manner with cleaning machines using a water-based cleaning composition with a pH above 7, characterized in that the cleaning composition contains A) 5 to 45% by weight of at least one polymer compound which is soluble in the alkaline range, is not crosslinked through metal ions and has a film-forming temperature of 0 to 80° C. and B) 2 to 90% by weight of a surfactant combination of alkoxylated linear $C_{8-18}$ fatty alcohol containing 1 to 10 ethylene oxide groups and 1 to 5 propylene oxide groups per molecule, the free OH group optionally being end-capped by a $C_{1-4}$ alkyl group, and at least one other surfactant from the group consisting of alkoxylated branched-chain $C_{8-18}$ alcohols containing 1 to 8 ethylene oxide units in the molecule, the free OH groups optionally being end-capped by a $C_{1-4}$ alkyl group, $C_{8-18}$ fatty alcohol ethoxylates containing 1 to 12 ethylene oxide units in the molecule and hydroxy mixed ethers corresponding to formula (I):

$$R^1O[CH_2CH(CH_3)O]_x(CH_2CH\ R^2O)_y[CH_2CH(OH)]_zR^3 \quad (I)$$

where $R^1$ is a linear aliphatic hydrocarbon radical containing on average 4 to 18 carbon atoms in the molecule, including mixtures thereof, $R^2$ is a hydrogen atom or an alkyl group containing 1 to 6 carbon atoms and $R^3$ is a linear aliphatic hydrocarbon radical containing on average 2 to 14 carbon atoms in the molecule, including mixtures thereof, x=0 or 1 to 5, y=1 to 30 and z=1 to 3.

EXAMPLES

The compositions of six formulations according to the invention and six comparison formulations are shown in Tables 1 and 2. The quantities of the individual components are percentages by weight, based on the final formulation and water-free raw materials.

The following water-soluble polymers were used:

Polymer 1 Syntran® 1503, polyacrylate dispersion from Interpolymer Corp., Massachusetts Polymer 2 Ubatol® U 3920, polyacrylate dispersion from Cray Valley, Tönisvorst Polymer 3 Primal® 644, polymer dispersion from Rohm & Haas, Philadelphia Polymer 4 Copolymer of 58% by weight methyl methacrylate, 30% by weight ethyl acrylate, 10% by weight acrylic acid, 2% by weight styrene

TABLE 1

Composition of the cleaners according to the invention

| Raw materials | 1 | 2 | 3 | 4 | 5 | 6 |
|---|---|---|---|---|---|---|
| $C_{10-14}$ alcohol + 5–8 EO/1–3 PO* | 3.5 | | 8.0 | | 7.0 | 3.0 |
| $C_{11-15}$ alcohol + 6 EO* | | | | 3.0 | | |
| $C_{12-14}$ alcohol + 4 EO* | | | | | 2.0 | |
| $C_{12-15}$ alcohol + 5–8 EO/2–5 PO* | | 3.0 | 1.0 | 1.0 | | |
| $C_{10-15}$ alcohol + 3–8 EO* end-capped by methyl groups | 1.5 | | 1.5 | | 3.0 | |
| $C_{10-15}$ alcohol + 3–8 EO* end-capped by butyl groups | | 2.0 | | 1.5 | | 1.0 |
| Polymer 1 | 15.0 | | | 5.0 | 12.0 | |
| Polymer 2 | | 8.0 | | 5.0 | | |
| Polymer 3 | | | 20.0 | | | 10.0 |
| Ammonia | 0.8 | | 1.2 | | 1.0 | 0.7 |
| Monoethanolamine | | 0.4 | | 0.6 | | |
| NTA-Na | 0.1 | 0.1 | 0.1 | 0.1 | 0.1 | 0.1 |
| Isopropanol | | 1.0 | | | 1.0 | |
| Ethylene glycol monobutyl ether | | | 1.5 | | 3.0 | |
| Sodium phosphate | 1.5 | | 2.0 | | | |
| Preservative | | | | | | |
| Cumene sulfonate Na | | | 1.5 | | | |
| Perfume | 0.1 | 0.1 | 0.2 | 0.1 | 0.1 | 0.1 |
| Dye | 0.002 | | 0.003 | 0.001 | | |
| Water to 100 | | | | | | |

*The degrees of alkoxylation shown represent average ranges or values.

TABLE 2

| Composition of known cleaners | | | | | | |
|---|---|---|---|---|---|---|
| Raw materials | R1 | R2 | R3 | P1 | P2 | P3 |
| $C_{12-18}$ is alcohol + 8–10 EO* | 8.5 | | 6.0 | 7.5 | | 3.5 |
| $C_{12-14}$ alcohol + 4 EO* | 2.0 | | | | 4.0 | |
| $C_{10-15}$ alcohol + 5 EO/4 PO* | 10.0 | 6.0 | | | | |
| $C_{10-15}$ alcohol + 5–10 EO* end-capped by methyl groups | | 5.0 | | | 4.0 | |
| $C_{8/11}$ alkyl polyglucoside (1.6 glucose units per molecule) | 2.5 | | 4.0 | 1.5 | | 3.5 |
| Polymer 1 | | | | 4.5 | | |
| Polymer 3 | | | | | 3.5 | |
| Polymer 4 | | | | | | 7.0 |
| NTA-Na | 0.2 | | | 0.1 | 0.1 | 0.1 |
| Na gluconate | | 0.8 | 1.2 | | | |
| Na phosphate | 3.0 | | | | | |
| Toluene sulfonate Na | | 2.4 | 0.7 | | | |
| Isopropanol | | | 2.4 | 0.5 | | |
| Ethylene glycol monobutyl ether | | 5.0 | | 1.2 | | 1.8 |
| $C_{8-18}$ ammonium soap | | | | | | |
| Preservative | 0.02 | | 0.01 | 0.02 | 0.02 | 0.02 |
| Perfume oil | | | 0.2 | 0.3 | 0.2 | 0.2 |
| Dyes | | | 0.0001 | | 0.0001 | 0.0003 |
| Water | | | | to 100 | | |

*The degrees of alkoxylation shown represent average ranges or values.

Testing of the Cleaning Effect

The cleaning effect of the floor cleaners was determined using a Gardner washability and scrubbing tester as described in the quality standards of the Industrieverband Putz- und Pflegemittel e.V. (Seifen-Öle-Fette-Wachse, 108, pages 526–528 (1982)). In this method, a white PVC film is coated with a test soil of soot and grease and machine-wiped under standardized conditions with a sponge soaked with the cleaner. Cleaning performance is measured by photoelectric determination of the degree of reflectance.

Testing of the Floor Care Effect

The floor-care effect is reflected inter alia in the fact that the removal of soils subsequently applied is facilitated by a film emanating from previous treatments with the same cleaner. Accordingly, the test described above was modified by wiping the film with the floor cleaner to be tested before application of the same soil and then drying it. After application of the soil, the test was carried out in the same way as the cleaning test.

Table 3 shows the results of the tests with all twelve cleaners. They are expressed in percent reflectance based on white=100%. In all the tests, the cleaners were applied in water-diluted form (concentration 2% by weight).

It is clear from the results that floor cleaners 1 to 6 according to the invention have an excellent cleaning effect both on non-pretreated and on pretreated film. The soil is removed even better from pretreated film than from the original film. By contrast, cleaners R1-R3/P1-P3 used for comparison show good cleaning performance only on non-pretreated film (6) or only on pretreated film. The known cleaners are entirely comparable with the cleaners according to the invention in their floor-care effect but—in contrast to the cleaners according to the invention—lead after repeated application to a buildup of film which spoils the natural appearance and nonslip behavior of the treated surfaces.

Testing of Resoiling

To determine resoiling, 0.5 to 1 m strips of fine stoneware tiles were wiped three times with a 15×15 cm cloth soaked with 5% product solution. The surface was not rewiped. After drying, the strips of tiling were exposed to normal pedestrian traffic. The arrangement of the test strips was changed daily. The test strips were evaluated by comparison with a pedestrian-free test strip. The test lasted 5 days with daily comparison and subsequent cleaning with 5% product solution. Evaluation was based on the following code: 0=as original, −=poorer results.

Measurement of Nonslip Behavior

The measurement was carried out with a Floor Slide Control FSC 2000, Sellmaier Elektronic Vertrieb GmbH, Walsertalstr. 4, 81476 München.

The sliding friction was measured using a neutral sliding medium (standardized filter paper).

The sliding friction coefficients set out in Table 1 represent the averages of 10 measurements.

The sliding friction coefficient of 0.650 represents the original covering. The lower the sliding friction coefficient, the more slippery the surface.

Testing of Foaming Behavior

Foam Value/foam Collapse

Procedure 50 ml of a 1% solution were poured into a 250 ml shaking cylinder which was then closed with a stopper. The cylinder was turned through 180° and back upright again 10 times in 20 seconds. The foam volume was read off immediately after the last tilting movement. The shaking cylinder was then left standing and the foam volume was read of again after 60 seconds. 50 ml was subtracted from the values read off for the particular solution.

The second value shown in the Table indicates the foam collapse, values above 70/70 ml indicating problems with too much foam of which the effect in practice is that the scrubbing vacuum cleaner cuts out prematurely because of the foam cushion and the cleaner cannot be used to its full capacity.

Testing of Dispersing Power

Dispersing power was determined with a standardized test soil by the shaking method.

Procedure 200 ml of a 2% cleaning solution were poured into a shaking cylinder, 0.2 g of Gardner soil was added and the cylinder was closed. The cylinder was turned through 180° and back upright again 10 times in 20 seconds. The cylinder was then left standing and the soil suspending capacity was determined as a function of time.

Evaluation

Evaluation was visual and was carried out immediately and after 30, 60 and 120 seconds according to the following scheme:

1=very good dispersing capacity—the soil particles are uniformly dispersed in the solution 2=good dispersing capacity—some of the soil particles settle on the surface 3=average dispersing capacity—most of the particles settle on the surface, a small amount remaining in the solution 4=poor dispersing capacity—all the particles settle on the surface.

TABLE 3

| | Technical properties | | | | | |
|---|---|---|---|---|---|---|
| | Cleaning: whiteness measurement[1] | Care: whiteness measurement[1] | Resoiling: tackiness[2] | Foam activity: generation, collapse[3] | Nonslip behavior: measured after wiping[4] | Disperse[5] |
| 1 | 72 | 78 | 0 | 55/45 | 0.662 | 1/1/2 |
| 2 | 74 | 70 | −0.5 | 45/40 | 0.644 | 1/1/2 |
| 3 | 79 | 84 | 0 | 60/40 | 0.620 | 1/1/1 |
| 4 | 69 | 74 | 0 | 40/40 | 0.638 | 1/1/1 |
| 5 | 74 | 73 | −0.1 | 60/55 | 0.660 | 1/1/2 |
| 6 | 71 | 75 | −0.5 | 40/40 | 0.610 | 1/1/2 |
| R1 | 78 | 58 | −2 | 125/125 | 0.668 | 1/2/4 |
| R2 | 79 | 60 | −3 | 110/110 | 0.643 | 1/2/4 |
| R3 | 72 | 56 | −2 | 130/125 | 0.620 | 1/3/4 |
| P1 | 60 | 70 | −1 | 125/125 | 0.604 | 1/3/4 |
| P2 | 58 | 65 | −1 | 90/85 | 0.581 | 2/4/4 |
| P3 | 62 | 78 | −0.5 | 130/120 | 0.342 | 1/4/4 |

[1]= the higher the value, the better the result, max. 100

[2]= +/− evaluation 1–5

[3]= critical limit 70/70 ml-values above 70/70 unsuitable

[4]= original sliding friction coefficient 0.650 the lower the value, the more slippery the floor

[5]= the lower the number, the better the result

What is claimed is:

1. A water-based composition with a pH above 7 for cleaning hard surfaces, characterized in that it contains A) 5 to 45% by weight of at least one polymer compound which is soluble in the alkaline range, is not crosslinked through metal ions and has a film-forming temperature of 0 to 80° C. and B) 2 to 90% by weight of a surfactant combination of alkoxylated linear $C_{8-18}$ fatty alcohol containing 1 to 10 ethylene oxide groups and 1 to 5 propylene oxide groups per molecule, the free OH group optionally being end-capped, by a $C_{1-4}$ alkyl group, and at least one other surfactant selected from the group consisting of alkoxylated branched-chain $C_{8-18}$ alcohols containing 1 to 8 ethylene oxide units in the molecule, the free OH groups optionally being end-capped by a $C_{1-4}$ alkyl group, $C_{8-18}$ fatty alcohol ethoxylates containing 1 to 12 ethylene oxide units in the molecule and hydroxy mixed ethers corresponding to formula (I):

$$R^1O[CH_2CH(CH_3)O]_x(CH_2CHR^2O)_y[CH_2CH(OH)]_zR^3 \quad (I)$$

where $R^1$ is a linear aliphatic hydrocarbon radical containing on average 4 to 18 carbon atoms in the molecule, including mixtures thereof, $R^2$ is a hydrogen atom or an alkyl group containing 1 to 6 carbon atoms and $R^3$ is a linear aliphatic hydrocarbon radical containing on average 2 to 14 carbon atoms in the molecule, including mixtures thereof, x=0 or 1 to 5, y=1 to 30 and z=1 to 3.

2. A composition as claimed in claim 1, characterized in that components A and B are present in a ratio of 1:1 to 10:1.

3. A composition as claimed in claim 1, characterized in that it contains copolymers of (meth)acrylic acid with (meth) acrylates and/or styrene, as the polymer compound.

4. A composition as claimed in claim 1, characterized in that the pH is adjusted with an alkalizing agent selected from the group consisting of NaOH, KOH, ammonia, waterglass, alkali metal carbonates and/or amines.

5. A composition as claimed in claim 1, further comprising at least one of anionic and nonionic co-surfactants, alkalizing agents, alkaline complexing agents, water-miscible organic solvents, detersive salts, solubilizers and adjunct ingredients.

6. A composition as claimed in claim 1, further comprising anionic co-surfactants selected from the group consisting of $C_{8-22}$ alkane sulfonates, $C_{8-22}$ alkyl benzenesulfonates, $C_{8-22}$ alkyl sulfates, $C_{8-22}$ fatty acid ester sulfonates, $C_{8-22}$ fatty alcohol ether sulfates, fatty acid soaps and mixtures thereof.

7. A composition as claimed in claim 1, further comprising nonionic co-surfactants selected from the group consisting of of adducts of 13 to 40 moles of ethylene oxide with $C_{8-22}$ alcohols, adducts of 1 to 40 moles of ethylene oxide with $C_{8-22}$ alkyl phenols, alkyl polyglycosides and mixtures thereof.

8. A process for the machine cleaning of hard surfaces, said process comprising contacting said hard surface with a water-based cleaning composition which contains the following constituents:

A) 5 to 45% by weight of at least one polymer compound which is soluble in the alkaline range, is not crosslinked through metal ions and has a film-forming temperature of 0 to 80° C. and B) 2 to 90% by weight of a surfactant combination of alkoxylated linear $C_{8-18}$ fatty alcohol containing 1 to 10 ethylene oxide groups and 1 to 5 propylene oxide groups per molecule, the free OH group optionally being end-capped by a $C_{1-4}$ alkyl group, and at least one other surfactant selected from the group consisting of alkoxylated branched-chain $C_{8-18}$ alcohols containing 1 to 8 ethylene oxide units in the molecule, the free OH groups optionally being end-capped by a $C_{1-4}$ alkyl group, $C_{8-18}$ fatty alcohol ethoxylates containing 1 to 12 ethylene oxide units in the molecule and hydroxy mixed ethers corresponding to formula (I):

$$R^1O[CH_2CH(CH_3)O]_x(CH_2CHR^2O)_y[CH_2CH(OH)]_zR^3 \quad (I)$$

where $R^1$ is a linear aliphatic hydrocarbon radical containing on average 4 to 18 carbon atoms in the molecule, including mixtures thereof, $R^2$ is a hydrogen atom or an alkyl group containing 1 to 6 carbon atoms and $R^3$ is a linear aliphatic hydrocarbon radical containing on average 2 to 14 carbon atoms in the molecule, including mixtures thereof, x=0 or to 5, y=1 to 30 and z=1 to 3.

9. A composition as claimed in claim 2, characterized in that components A and B are present in a ratio of 5:1 to 1:1.

10. A composition -as claimed in claim 3, characterized in that it contains copolymers of methyl acrylate, ethyl acrylate, methacrylic acid and styrene as the polymer compound.

11. A composition as claimed in claim 4, characterized in that the pH is adjusted to a value of 8 to 10.

12. A method of cleaning a hard surface comprising diluting the composition of claim 1 and contacting said hard surface with the diluted cleaning composition.

13. The method of claim 12, wherein the step of contacting comprises machine cleaning of floors.

* * * * *